United States Patent [19]

Randall

[11] Patent Number: 5,040,788

[45] Date of Patent: Aug. 20, 1991

[54] EXERCISE APPARATUS AND METHOD FOR GOLF

[76] Inventor: Charles R. Randall, 283 W. Lake Samish Dr., Bellingham, Wash. 98226

[21] Appl. No.: 562,228

[22] Filed: Aug. 3, 1990

[51] Int. Cl.[5] ..... A63B 21/04

[52] U.S. Cl. ..... 272/136; 272/137; 272/142; 272/900; 273/186 C; 273/191 B; 273/193 A

[58] Field of Search ..... 273/191 R, 191 A, 191 B, 273/186 C, 193 A; 272/68, 67, 136, 135, 900, 901

[56] References Cited

U.S. PATENT DOCUMENTS

| | | | |
|---|---|---|---|
| 2,655,378 | 10/1953 | Sheffer | 273/191 B |
| 2,848,234 | 8/1968 | Brandon | 272/68 |
| 4,205,839 | 6/1980 | Best | 272/900 X |
| 4,545,575 | 10/1985 | Forjot | 272/97 |
| 4,575,076 | 3/1986 | Riechert et al. | 272/901 X |
| 4,878,673 | 11/1989 | Pollard | 273/193 A |
| 4,944,518 | 7/1990 | Flynn | 273/193 A |

*Primary Examiner*—Richard J. Apley
*Assistant Examiner*—L. Thomas
*Attorney, Agent, or Firm*—Hughes & Multer

[57] ABSTRACT

A golf exerciser comprising a handle to be manually grasped, a stretchable cord assembly attached to one end of the handle, with the other end of the cord assembly attached to a doorknob. The person assumes a golfing stance and grasps the handle in the lead hand (which for a right handed golfer would normally be the left side), and pulls the handle away from the doorknob, thus strengthening the muscle in the left hand. The cord assembly desireably comprises one cord of a shorter unstretched length, and a second cord of a greater unstretched length, so that there is a lead-in exercise motion with lesser resistance, followed by a power mode where a handle is pulled and rotated by the wrist to give isometric exercise.

4 Claims, 4 Drawing Sheets

EXERCISE APPARATUS AND METHOD FOR GOLF

FIELD OF THE INVENTION

The present invention relates to an exercise apparatus and method, and more particularly to an apparatus and method particularly designed to assist a golfer in developing certain muscle sets to add power (as well as control) to the golf swing.

BACKGROUND OF THE INVENTION

Most golfers wish to add power to their golf swing, and yet have this accomplished in a manner that timing and precision of the golf swing is not adversely affected (and hopefully so that timing and precision are enhanced). If a golfer is right handed, the usual golfing stance is such that the club is gripped with the left hand being uppermost on the club, with the person standing so that the left hand is the leading hand (i.e. the left side of the person facing the direction of the swing). Many golf professionals, such as Ben Hogan, advocate that the golf swing should be executed in a manner that both the left hand and the right hand share more or less equally in supplying the power to the golf swing. Unfortunately, a right handed golfer will quite often apply most of the power with the right hand, using the left hand more as a guide to control the stroke. The opposite would be true of a left handed golfer.

Another aspect of the game of golf is that maximum power is normally developed during the middle portion of the stroke when the club is at the lowermost portion of the arc so as to be striking the ball. At this time, the shaft of the club is directed downwardly and moderately forwardly, and the inertia of the golf club which resists the accelerating force supplied by the hands is directed into the handle of the golf club about a moment arm where the resisting force is directed horizontally and rearwardly.

Over the years, there have been a number of golf exercise devices which have appeared in the patent literature. A search of the patent literature has disclosed the following patents.

U.S. Pat. No. 2,848,234 (Brandon) shows what is called a "golf swing conditioner" which comprises an elastic cord 10 that is to be stretched between a hook 12 on a wall or structure 13. The opposite end of the elastic cord is connected to a handle designed to resemble a golf club handle. The device is used to imitate a golf swing against the elastic cord, and as shown, the connecting location 12 is at an eye level or above of the golfer.

U.S. Pat. No. 3,462,156 (Gentry) shows a "golf practice device" which is similar to the above mentioned Brandon patent, where the cord is wound on a spring loaded reel 5. The reel 5 is positioned so that as shown, the elastic cord 4 extends downwardly at about a 45° angle.

U.S. Pat. No. 4,229,002 (Masters) shows a golf swing exercise device where there is a handle 26 attached to a cord that goes over two pulleys 21 and 20 to attach to a weight 23. The invention is described as having a mount for the pulleys at an upper location such as a top of a door, so it would appear that in use the handle would pull the cord in a downward direction with a substantial vertical slant.

U.S. Pat. No. 4,135,714 (Hughes) shows a golf exercising device where there is a flexible cord attached to a spring loaded reel mounted at a location above the person's head.

U.S. Pat. No. 4,030,732 (Vincent) shows a tennis racket that is fastened to a player by a rubber spring element 5.

U.S. Pat. No. 3,966,203 (Bickford) shows a golf exercise device where the head of the golf club is connected by a cord which extends at an upward slant to a weight.

U.S. Pat. No. 3,804,420 (Boyd) shows a spring loaded reel which is attached to the golfer's belt, with a cord running from the reel to the golf club to aid in training golfers.

U.S. Pat. No. 2,103,502 (Webster) shows a golfer's harness that is worn by the golfer and connected at the other end to a golf club. The harness is made of a cord 6 that is secured to a belt by a rubber tube 8 and spring 7.

U.S. Pat. No. 1,983,920 (Perin) shows a golf swing practice device in which weights 30 and 33 provide the exercise resistance. This device clamps onto the golf club itself.

U.S. Pat. No. 1,137,349 (Patterson) shows an exercising machine where a handle is attached a cord 1 which engages a pulley 2 and then is connected to a spring loaded reel 5. In FIGS. 1 through 3, the pulley is shown at three different locations, namely a lower location, where it is positioned to develop the muscles to use in lifting the club preparatory to making the swinging stroke, an upper position in developing the muscles used in making the first or downward part of the swinging stroke, and a third intermediate position of FIG. 3 to exercise the muscles brought into play at the moment the ball is struck by the club.

U.S. Pat. No. 3,677,543 (Richardson) shows an "elastic pull type exerciser" where a connecting member is shown tied to a low position of a leg of a piece of furniture.

U.S. Pat. No. 4,809,975 (Lee) shows an exerciser where there is a weight mounted for movement down the length of a shaft simulating a golf club. As the shaft is swung, the weight moves down the shaft against the urging of a spring so as to provide increased resistance.

SUMMARY OF THE INVENTION

The present invention comprises an apparatus and method which is structurally simple, convenient to use, and structured in a manner that it provides exercise primarily for the muscle sets that are used to in the "power" portion of the golf stroke when the ball is being struck. Within the broader scope of the present invention, the apparatus could be used in training muscle sets for sports other than golf.

The apparatus comprises a handle means having an upper end, a lower end, and a main elongate grip portion with a lengthwise axis, adapted to be gripped in at least one hand of a person. There is a cord means having a first end connected to the lower end of the handle means and a second end. The second end of the cord means is connected to a doorknob means positioned between two to four feet above a floor surface, and desirably at a three foot height.

Thus, a person standing on the floor surface is able to grasp the handle in at least one hand, and with the person being in a golfing stance, the person can pull the handle away from the doorknob in a manner to simulate the movement of the person's hand in executing a golf swing during the lower arc of the swing of the golf club, with the cord means exerting a resisting force against the movement of the handle means along a substantially horizontal axis. The present invention is particularly adapted for being grasped by the person's "leading hand", the intent being to strengthen this hand so that substantially equal power can be derived from both hands in the golf swing.

In the preferred form, the second end of the cord means is removably connected to the doorknob means. One form of accomplishing this is to form the second end of the cord means with an end loop through which a portion of the cord means can be inserted so as to provide a closed connecting loop to engage the doorknob means. A second means of accomplishing this is to form the second end of the cord with an end loop having a slide connector which can be moved forwardly and rearwardly to increase or decrease the size of the loop.

Desirably, the cord means comprises at least one elastic cord section to provide an increasing resisting force as the handle means is moved further from the doorknob means. In one arrangement, the cord means comprises a first cord section having a lesser resisting force to a given increment of elongation, and a second cord means having a greater resisting force to said given increment of elongation.

Also, in a preferred configuration, there is a first cord section having an unstretched length of a first lesser amount, and a second cord section having an unstretched length of a greater amount. Thus, when the handle means is moved in an exercise motion to elongate the cord assembly, the handle means is moved through a first lead in path where the cord assembly provides lesser resistance for increment of travel, and then into a power phase where greater resistance is exerted against further travel of the handle means. This arrangement has a desirable psychological effect in that the person's reaction is to put substantial effort into the isometric exercise provided in the power mode of operation. A third cord section and additional cord sections beyond that can be added.

In the method of the present invention, an apparatus is provided as indicated above, and the second end of the cord means is attached to a structure such as a door knob at a connecting location between two to four feet above a floor surface (desirably at three feet above) on which a person is standing. The person then assumes a golfing stance where a forward swing of a golf club would be directed away from the connecting location. The person is spaced from the connecting location so that when the person moves the handle means of the apparatus away from the connecting location so as to stretch the cord means, with the handle means at a downward position simulating the location of the handle of the golf club striking the golf ball, the cord means is stretched to provide adequate resisting force to give proper exercise to the muscles of the person utilized in the power mode of the golf swing, in the manner indicated above.

Other features will become apparent from the following detail description.

BRIEF DESCRIPTION OF THE DRAWINGS

FIG. 11 A, 11B and 11C show in sequence the rotation of the handle in the exercise motion.

DESCRIPTION OF THE PREFERRED EMBODIMENT

Figure 1:
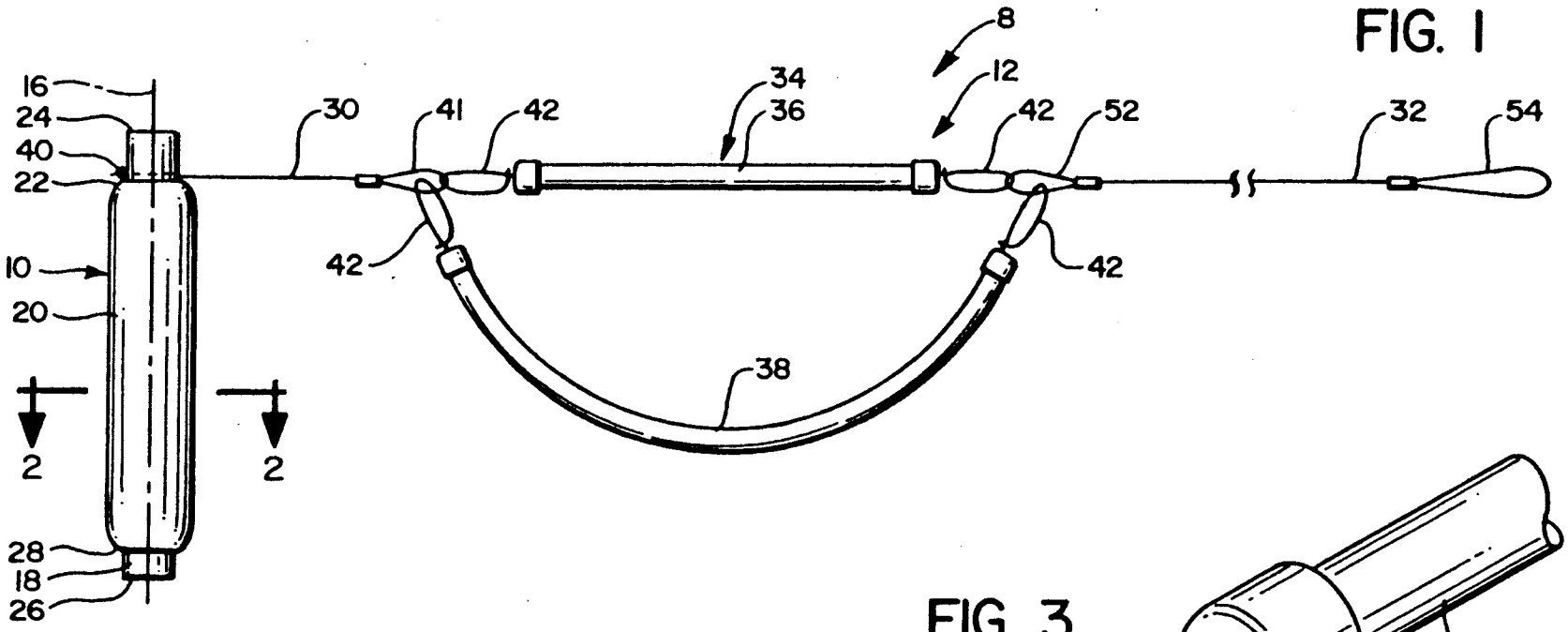
FIG. 1 is a side elevational view of the apparatus of the present invention.
Figure 3:
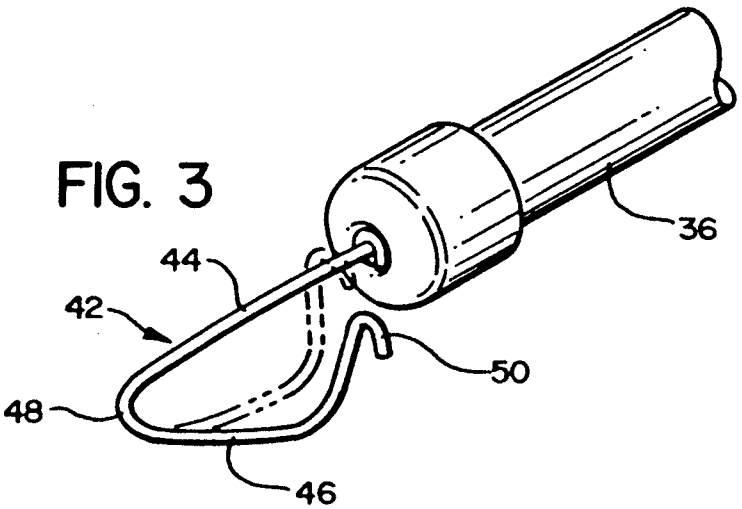
FIG. 3 is an isometric view of one of two connecting members which are at two end cord locations on one of the cords in the present invention.
Figure 2:
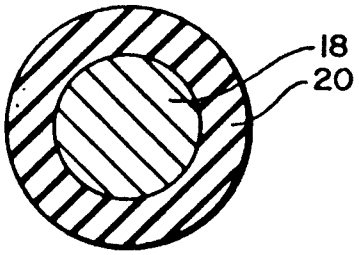
FIG. 2 is a transverse sectional view of the handle of the present invention, taken along line 2—2 of FIG. 1.

The present invention generally designated 8, comprises basically a handle 10, which is adapted to be grasped by the golfer, and a cord assembly 12, which is interconnected between the handle 10 and a desired anchoring member which in the preferred form of the invention is a conventional doorknob 14.

The handle 10 has an overall elongate configuration having a lengthwise axis 16. There is a core portion 18 made of a structurally rigid material, such as metal tubing or wood, and an outer resilient portion 20 made of a resilient material such as rubber, compressible foam, or some other like material. In the particular embodiment of the present invention, the core portion 18 has a cylindrical configuration, with a diameter of about three quarter inch. The lengthwise dimension of the core member 18 is desirably long enough so that the handle 10 can conveniently be grasped in at least one hand of the user, and preferably so that under some circumstances it an be grasped by both hands of the user when the user grips the handle 10 in the manner of conventional golf grip. In the preferred embodiment shown herein, the length dimension is between six to eight inch, and more preferably between about six and one half to seven inches.

The sleeve 20 has an inside diameter about the same as, (or slightly smaller than) that of the core portion 18 so that the sleeve 20 can grip the core portion 18 snugly. The sleeve 20 has a length dimension moderately smaller than that of the core portion 18, and as shown, the lower end 22 of the sleeve 20 is positioned a short distance upwardly (e.g. one half to one inch) of the extreme lower end 24 of the core portion 18 to permit the cord assembly 12 to attach to the lower end of the core portion 18 without being obstructed by the sleeve 20. The upper end 26 of the core member 18 is shown as extending a short distance upwardly from the upper end 28 of the sleeve 20, but these two ends 26 and 28 can be at the same location. The sleeve 20 is desirably of a length so that it could be conveniently grasped by at least one hand of the user or golfer, or in an alternative configuration by both hands of the golfer when engaging the handle 10 in a full golf grip. In a preferred embodiment, the length of the sleeve 20 is between about five to seven inch, and desirably between about five to six inches. The outside diameter of the sleeve 20 when it is unstressed is between about one to one and one quarter inches.

The cord assembly 12 of this preferred embodiment comprises a front cord portion 30, a rear cord portion section 32, and an intermediate cord section 34 which in this particular embodiment comprises a first lead in cord 36, and a second power cord 38. Additionally cords 36 and/or 38 could be added. In this preferred embodiment, the two end cord sections 30 and 32 are flexible, but substantially nonstretchable, while the two or more intermediate cord members 36 and 38 are resiliently stretchable or elastic. The forward cord section 30 is connected to the lower end of the core portion 18 just above the extreme lower end 24, with this connection conveniently being made by inserting the end of the front cord section 30 through an opening in the lower end of the cord portion 18 of the handle 10*a* and tying a knot 40 at the end of the cord section 30 to prevent the cord section 30 from being retracted back through the core portion 18 of the handle 10. The rear end of the front cord section 30 has a loop 41 to connect to the two or more cord sections 36 and 38.

There is a releasable connecting member 42 on each end of each cord 36 and 38. Each connecting member 42 is U-shaped and comprises two legs 44 and 46 which connect at a loop position 48, and with the leg 44 be connected to its related cord end. The arm section 48 has a catch member 50, and the connecting member 42 has a certain amount of spring so that the catch member 50 can be resiliently pushed into and out of its securing position indicated in broken lines in FIG. 15, with the leg 44. Other types of connectors 42 could be used.

Figure 4:
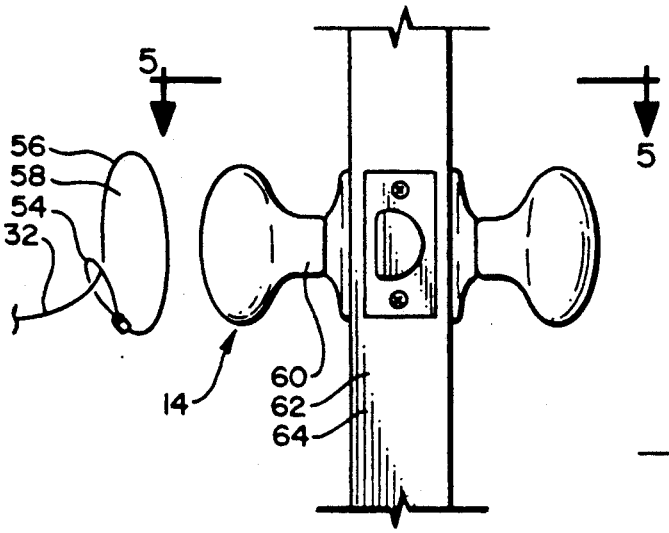
FIG. 4 is an elevational view of a doorknob location of a door, with the connecting end of the cord of the present invention being shown in a position to be attached to one aide of the doorknob.
Figure 5:
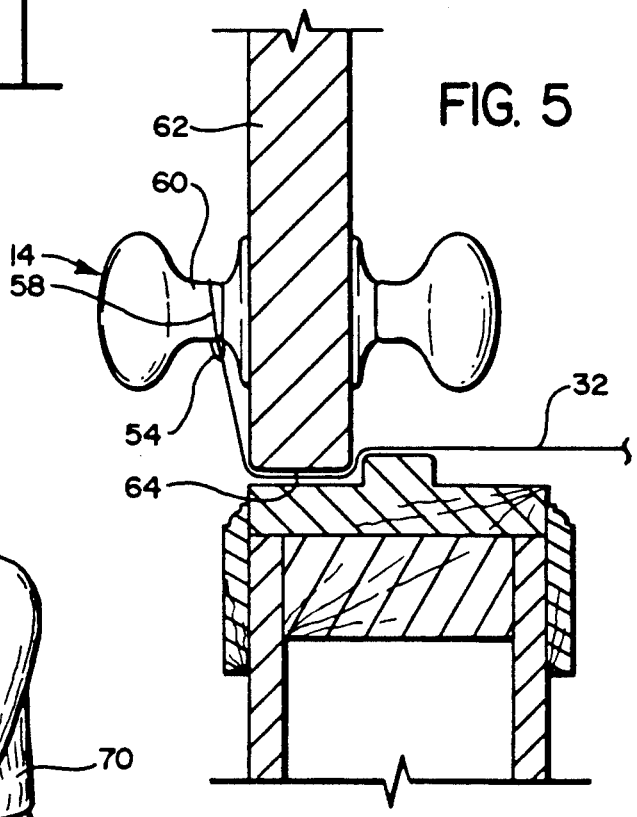
FIG. 5 is a sectional view taken along line 5—5 of FIG. 4, taken at a location above the doorknob and showing the cord being attached to the doorknob on the far side of the door for use in the present invention, and with the door closed.

The rear cord portion 32 has at its forward end a connecting loop 52 which connects to the releasable connecting members 42 at the rear end of the cords 36 and 38. At its rear end, the rear cord portion 32 has a closed rear end loop 54. This end loop 54 enables the rear cord section 32 to be very conveniently attached to an anchoring member, such as the doorknob 14. More specifically as illustrated in FIG. 4 a portion 56 of the rear cord portion 32 is pushed through the loop 54 so as to form an enclosed connecting loop (the middle of which is shown at 58) which can be slipped over the doorknob 14 and then pulled tight, as shown in FIG. 5, so as to fit securely over the necked down portion 60 of the doorknob 14. As shown in FIG. 5, it is desirable that the cord be looped around the doorknob member 14 which is on the far side of the door 62, with the rear cord section 32 extending along the side edge 64 of the door. Thus, the door can be securely closed, so that the doorknob 14 provides a stationary anchoring member. Alternatively, the rear connecting loop 54 could be replaced by another type of connector, such as a flexible loop with a slide closing member, as described later herein.

An advantageous feature of the present invention is the particular arrangement of the lead in cord 36 and the power cord 38. As a preliminary comment, in the particular embodiment shown herein, there is only one lead in cord 36 and one power cord 38. However, a plurality of such cords 36 and 38 can be provided, so that cords 36 and/or 38 can be added or subtracted, depending upon the strength of the golfer or the amount of resistance which that particular golfer wishes to have in utilizing the apparatus.

In the preferred embodiment shown herein, the lead in cord 36 is made of a resilient material which can stretch to as great as possibly several times its original length. In one form, the lead in cord 36 can be made more easily stretchable so that it provides a lesser level of resistance for a given amount of elongation. Further, the lead in cord 36 is shorter than the power cord 38, and in the preferred form, the lead in cord 36 has a total lengthwise dimension (measured from the end of the its connecting loops 68) of between six to ten inches, and in this preferred form between about eight to nine inches.

The power cord 38 has two end connectors 42 which can be the same as the connectors 42 of the lead in cord 36. The total unstretched length of the power cord 38 (measured from the end of its connectors 42) can be about ten to sixteen inches. In the preferred embodiment shown herein, the length of the power cord 38 is about fourteen inches. The reason for this arrangement will become more apparent when the operation of the present invention is described below.

To describe now the operation of the present invention, reference is made to FIGS. 4 through 10. The first step is to secure the rear end of the back cord section 32 to an anchoring member, which in this preferred embodiment is (as indicated previously) a doorknob 14. As discussed previously, an end loop 58 is formed by pushing a cord portion 56 through the cord loop 54, and this loop 58 is placed over a doorknob 14 and pulled so that it securely grips the necked down portion 60. Desirably this is done by opening the door 62 and securing the loop 58 around the far side doorknob 14, and moving the rear cord portion 32 by the door edge 64. Then the door 62 is closed so that the back end of the cord section 32 is securely anchored to the far side knob 14.

In the further description of the operation of the present invention, it will be assumed that the user is a right handed golfer, so that the golfer swings the club in a manner that the club moves from the up position downwardly through an arc that extends from right to left as the ball is struck. The direction of swing at the lower part of the arc where the club strikes the ball will be considered as the forward direction, so that as the club moves from right to left, it is considered to be moving forwardly. In like manner, as the handle 10 is moved toward the left so as to stretch the cord assembly 12, that right to left movement of the handle 10 shall be considered movement in a forward direction away from the doorknob 14.

To continue the description of the operation of the present invention, the golfer, indicated at 70, assumes a conventional golfing stance a short distance forwardly of the location of the door 62. In this particular mode of use, it will be assumed that the golfer is exercising only the golfer's left hand. (As indicated previously if the golfer happens to be a left handed golfer so that the stance is reversed, then any reference to the terms "left"

or "right" will simply be reversed.) At any rate, for this particular mode of use, the person grips the handle 10 with the left hand in a grip which is similar to the manner in which the person would normally grip the handle of a golf club with the left hand.

Figure 6:
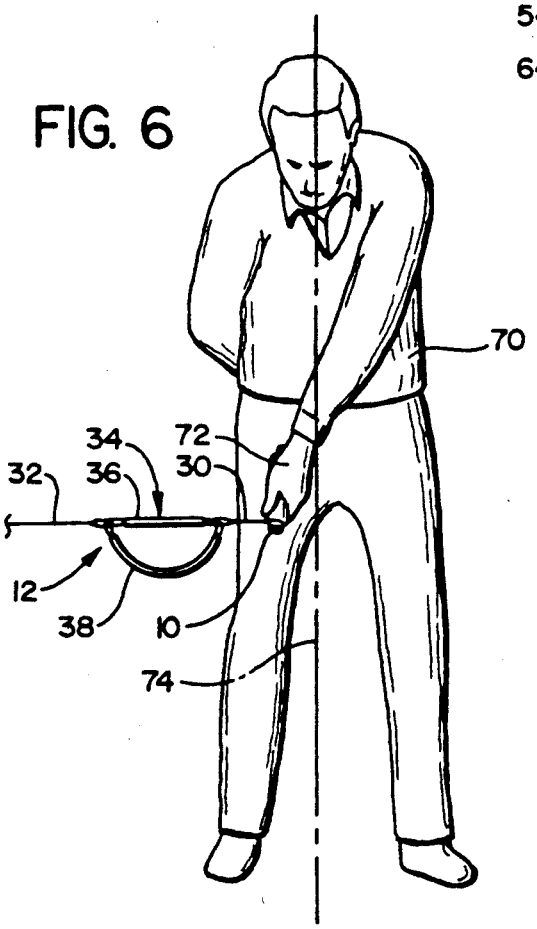
FIG. 6 is a front elevational view of a golfer using the apparatus of the present invention at the initiation of the exercise stroke during the "lead in" movement.
Figure 7:
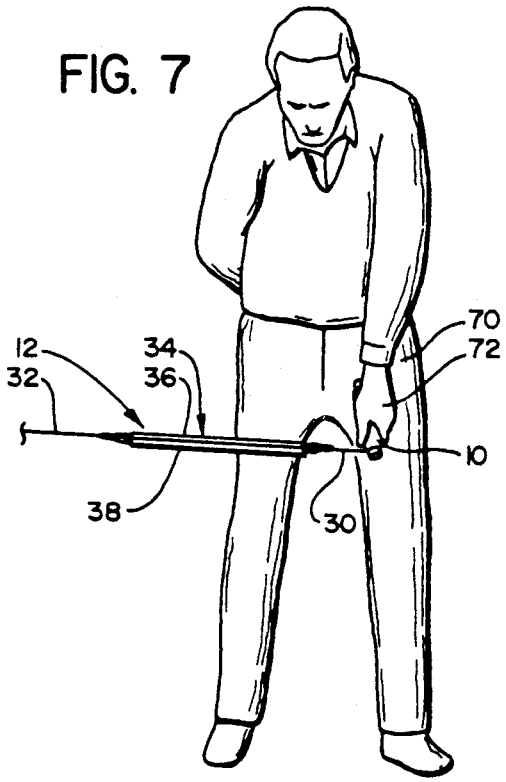
FIG. 7 is a view similar to FIG. 7, but showing the golfer completing the lead in portion of the exercise stroke and moving into the power portion.
Figure 8:
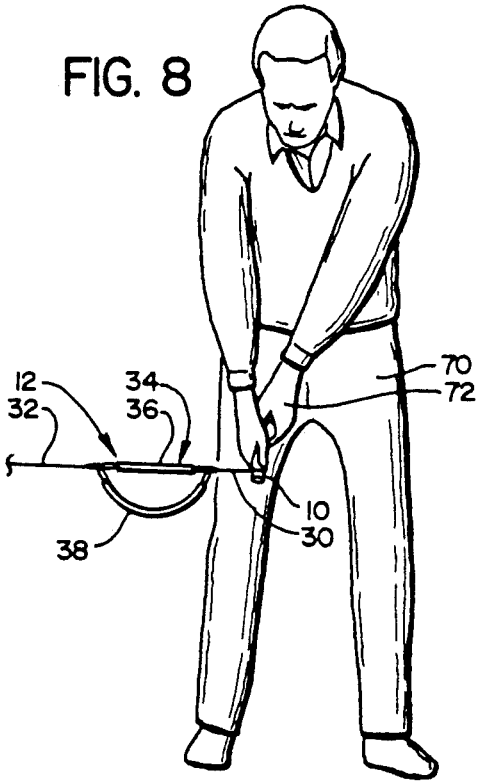
FIG. 8 is a front elevational view showing both hands of the golfer grasping the handle portion of the present invention.
Figure 9:
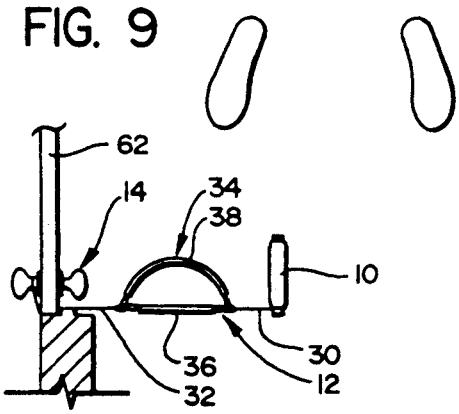
FIG. 9 is a somewhat schematic top plan view showing the two foot locations of the person, with the handle of the present invention located at the start of the exercise motion (corresponding to FIG. 6) going into the lead in phase.
Figure 10:
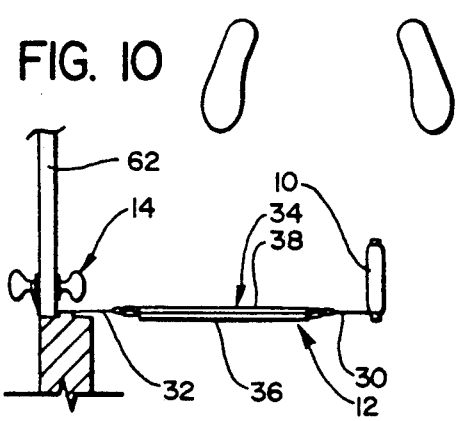
FIG. 10 is a view similar to FIG. 9, but showing the handle position at the start of the power mode (corresponding to location of FIG. 8)

Then the golfer spaces himself (the term "himself" being intended to refer both to a male or female golfer) so that the when the left hand 72 is positioned a moderate distance rearwardly (i.e. to the right) of the vertical centerline 74 of the golfer, the lead in loop 36 is pulled up to its horizontal position without being stretched, while the power cord 38 is extending downwardly in a moderate loop, as shown in FIG. 6.

As the golfer pulls the handle 10 from the position of FIG. 6 further forward toward or just beyond the center location 74, the lead in cord 36 stretches to provide moderate resistance. At the same time, the power cord 38 is being caused to move upwardly toward a horizontal straightline position.

By the time the person has moved the handle 10 to a location beyond the person's vertical centerline 74, the power cord 38 is also being stretched and begins to provide substantially greater resistance to further forward movement of the handle 10. At the same time that the person is moving the handle 10 forwardly, the person would usually be rotating his left wrist so as to point the handle 10 more directly downwardly, with a moderate forward slant, simulating the rotation or "breaking" of the wrist in a conventional golf swing.

The resistance to stretching of the power cord 38 and the lead in cord 36 is sufficient so that a person having strength within a normal range would not be able to move the handle a great deal further beyond the vertical centerline 74. Thus, it can be seen that at such time as the power cord 38 becomes moderately stretched, the exercising motion has moved into an isometric mode where further forward motion of the handle 10 is stopped. It has been found that this arrangement of the cords 36 and 38, giving the lower resistance lead in motion and the higher resistance power mode has something of a psychological effect of in a sense motivating the user to exert maximum isometric force as the user moves the handle to the power mode position.

Within the broader scope of the present invention, a somewhat similar psychological effect can be achieved by having the cord assembly stretch in a more or less conventional manner where the resistance to stretching increases proportionately to the amount of stretching. In this instance, there would be a single cord 36 or 38 of adequate resistance to stretching, or a plurality of such cords 36 and/or 38 of the same unstretched length. However, the total increase in length from the unstretched to the maximum stretched position should be no greater than two feet, and desirably at least as great as about a half a foot, with a more optimized range being between one foot to one and one half foot of stretching. In this arrangement, there is not a distinct transition from the lead in phase to the power mode, but more of a uniformly increasing resistance to stretching so that the demarcation between the lead in phase and the power mode is somewhat obscured. Nevertheless, some of the benefit of the present invention can be used with this arrangement. This is in contrast to some of the prior art devices which provide a tensioning cord where the tension is provided by weights, so that the amount of tension is uniform throughout the movement, and also in contrast to those prior art devices which provide a resisting spring permitting substantially greater elongation.

As the person moves the handle 10 to its furthest forward location so as to go into the isometric mode, the person using the exercise apparatus is stressing (a) the forearm muscle that are used to grasp the handle 10 and rotate the wrist in that portion of the golf swing, (b) the person's tricep muscles in the left arm, and (c) the left back and shoulder muscles. The person can repeat this motion several times, moving from right to left initially in the moderately resisting lead in motion, followed by the high resistance isometric power position.

To discuss another facet of the present invention, it will be noted that the average height of a doorknob 14 is about three feet. Thus, for adults within a reasonable height range, the location of the handle 10 will be at approximately the same height as that of the doorknob 14. The result is that the stretched cord assembly 12 is nearly horizontal in its normal use mode so that the resisting force of the cord assembly 12 is substantially horizontal in a rearward direction. Thus, the cord assembly 12 is providing its greatest effective resistance when the handle 10 is pointing more nearly downwardly.

Figure 11A:
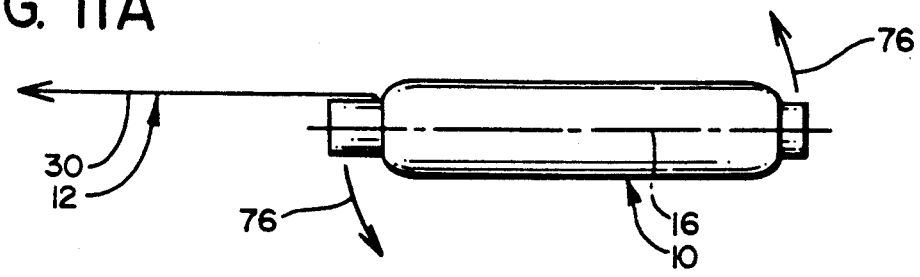
FIG. 11 shows an alternative configuration of the second connecting end of the cord means.
Figure 11B:
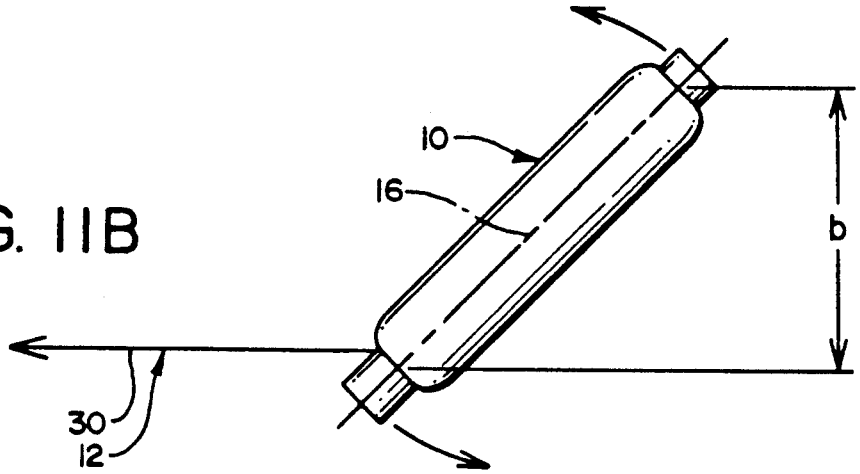
Figure 11C:
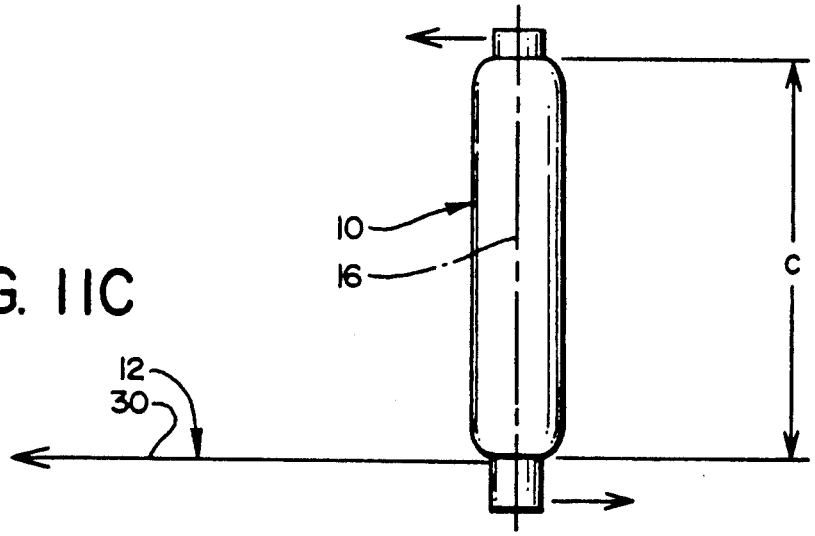

To explain this further, reference is made to FIG. 11*a* through 11*c*. It can be seen in FIG. 11*a* that the handle 10 is extending horizontally toward the rear, so that the cord assembly 12 is pulling along a line which is parallel to the lengthwise axis 16 of the handle 10. At this time, the cord assembly 12 is offering no resistance to the rotation of the handle, since the direction of rotation as indicated by the arrows 76 is perpendicular to the cord section 30.

When the handle 10 is rotated 45° from the horizontal, the rearward component of the force of the cord assembly 12 is exerted so that the result is that further rotational movement of the handle 10 is along a line slanted 45° from the horizontal and the vertical so that the effective moment arm (indicated at "m") which can be considered equal to the vertical distance between the two ends of the handle 10 (this being indicated at "b" in FIG. 10*b*) is still less than the length of the handle 10 so that the resisting force of the cord assembly 12 to rotation of the handle 10 does not have maximum moment arm. However, when the handle 10 has moved toward its vertical (the downwardly directed) position of FIG. 10*c*, the resisting force of the cord assembly 12 is exerted along the moment arm of the handle 10 which is at a maximum length, as indicated as "c" in FIG. 10C. Thus, maximum wrist power is required at the position where the handle 10 is positioned at a location that is quite close to the position where the handle of a conventional golf club would be striking a ball. Thus, as the cord assembly 12 stretches further, both the tension force of the cord assembly 12 and the moment arm length are increased. As indicated above, the psychological effect on the user is that the handle 10 is at the location of the golf ball striking position, and maximum force is required. The lesser resistance of the lead-in motion and the sharply increasing resistance in the power mode, in moving from the position of FIG. 6 to FIG. 7 contributes to this psychological effect.

By way of clarification, it is to be recognized that when the handle 10 is described as pointing directly vertically, it is actually at a moderate downward slant away from the user (i.e. the golfer), so the handle 10 is not truly vertical. However, for purposes of the present discussion, the term "vertical" shall be considered as being parallel to the alignment of the shaft of the golf club when the golfer is addressing the ball before initiating the golf swing, so that the apparent alignment of the handle 10 from a position viewed facing the golfer who is using the apparatus appears vertical. Thus, when the handle 10 is moderately beyond the person's vertical center axis 72 in appearance from a location facing the golfer to be aligned with that axis 84, the handle 10 would be considered as being vertical. However, the handle 10 is positioned so as to have maximum length of moment arm.

From the foregoing discussion, it can readily be seen that an advantageous feature of the present invention is that aside from the convenience of being able to be attached to the doorknob so as to provide a stationary anchor, the usual doorknob is positioned so that the position of the alignment of the force exerted by the cord assembly 12 is in the optimized horizontal position.

Also, it should be noted that while the present invention is ideally suited to exercising the lead arm (i.e. the left arm for a right handed golfer), it could be utilized by the person grasping the handle 10 with both hands (see FIG. 8), or either the right or left hand. Further, it is to be recognized that a plurality of stretchable cord sections, such as those shown at 36 and 38 can be used to provide different levels of strength. For example, the lead in cord 36 and/or the power cord 38 could be made as three cords, with the first cord providing a first resistance of "x" to a given increment of the stretching, while the second cord could provide a resisting force of "2*x*" for each increment of stretching, and the third cord could provide a resistance of "4*x*" for that increment of stretching. Thus, in this example, depending upon the quantity and selection of these cords, seven different levels of stretching resistance could be obtained all the way from "x" through "7*x*".

Figure 12:
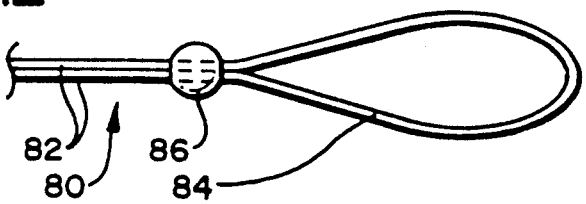
FIG. 12 shows an alternative configuration of the second connecting end of the cord means.

In a modified form of the present invention, the rear cord portion 32, as shown in FIG. 12, at 80, comprises two side by side cords 82 making an end loop 84, with a slide connector 86 connecting the two cords 82. The slide connector 84 can be moved forwardly to increase the size of the loop 84 so that it can be slipped over the doorknob 14 and then made more secure by moving the slide member 86 rearwardly to decrease the length of the connecting loop portion 84.

It is apparent that various modifications could be made without departing from the basic teachings of the present invention.

What is claimed is:

1. A method of exercising wrist and arm muscles of at least one arm of a person for golf or some other sport, said method comprising:

a. providing an exercise apparatus comprising:

i. a handle having an upper end, a lower end, and a main elongate grip portion with a lengthwise axis, adapted to be grasped in at least one hand of a person;

ii. a cord means having a first end connected to the lower end of the handle means and a second end;

b. connecting the second end of the cord means to door knob means having a height dimension between two to four feet above a floor surface;

c. assuming a stance where one side of the person is at a forward location further from the doorknob means, and the second side of the person is at a rearward position closer to the doorknob means, with the person being spaced from the door knob means in a manner that the handle, with the cord means in an unstretched position is positioned closer to the side of the person closer to the doorknob means;

d. manually grasping said handle and moving said handle away form the doorknob means toward the forward side of the person, in a manner that said cord means is stretched and provides resistance against the person manually moving the handle away from the doorknob means.

2. The method as recited in claim 1, wherein said person assumes a golfing stance, and said handle is initially positioned at a location of the handle corresponding to a location of a golf club prior to striking the golf ball, and said handle is moved to a forward position beyond a center location of the person where the handle position corresponds to a position of a golf club as it is striking the golf ball and moving into a follow through motion.

3. The method as recited in claim 2, wherein said cord means comprises a first cord means section having a lesser unstretched length, and a second cord section means having a greater unstretched length, with the person executing a first movement of the handle in a lead-in path where there is lesser resistance to elongation of the cord means, followed by the person moving the handle further in a power mode where there is a greater rate of increasing resistance for an increment of elongation, and with the person maintaining the power mode position at least momentarily in an isometric mode of exercise.

4. The method as recited in claim 1, wherein said cord means comprises a first cord means section having a lesser unstretched length, and a second cord section means having a greater unstretched length, with the person executing a first movement of the handle in a lead-in path where there is lesser resistance to elongation of the cord means, followed by the person moving the handle further in a power mode where there is a greater rate of increasing resistance for an increment of elongation, and with the person maintaining the power mode position at least momentarily in an isometric mode of exercise.

* * * * *